US009733004B2

(12) United States Patent
Mitchell et al.

(10) Patent No.: US 9,733,004 B2
(45) Date of Patent: Aug. 15, 2017

(54) REFRIGERATOR APPLIANCES

(71) Applicant: General Electric Company, Schenectady, NY (US)

(72) Inventors: Alan Joseph Mitchell, Louisville, KY (US); Charles Benjamin Miller, Louisville, KY (US); Bart Andrew Nuss, Fisherville, KY (US); Ansuraj Seenivasan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 236 days.

(21) Appl. No.: 14/596,270

(22) Filed: Jan. 14, 2015

(65) Prior Publication Data

US 2016/0201967 A1 Jul. 14, 2016

(51) Int. Cl.

| | |
|---|---|
| ***F25C 5/00*** | (2006.01) |
| ***F25D 29/00*** | (2006.01) |
| ***F25C 5/18*** | (2006.01) |

(52) U.S. Cl.

CPC ..... *F25C 5/005* (2013.01); *F25C 5/187* (2013.01); *F25D 29/005* (2013.01); *F25C 2400/04* (2013.01); *F25C 2500/08* (2013.01); *F25C 2700/02* (2013.01)

(58) Field of Classification Search

CPC .. F25C 1/147; F25C 2500/08; F25C 2700/02; F25C 2400/04; F25C 5/005; F25C 5/002; F25C 5/187; F25D 29/005

See application file for complete search history.

(56) References Cited

U.S. PATENT DOCUMENTS

| | | | | |
|---|---|---|---|---|
| 3,731,496 | A | 5/1973 | Frazier | |
| 5,060,484 | A | 10/1991 | Bush et al. | |
| 5,172,595 | A * | 12/1992 | Bush | F25C 5/187 403/348 |
| 5,671,606 | A | 9/1997 | Schroeder et al. | |
| 6,286,324 | B1 | 9/2001 | Pastryk et al. | |
| 6,314,745 | B1 * | 11/2001 | Janke | F25C 5/005 62/137 |
| 6,324,855 | B1 | 12/2001 | Mullis | |

(Continued)

FOREIGN PATENT DOCUMENTS

| | | | | |
|---|---|---|---|---|
| IT | WO 2013189730 | A1 * | 12/2013 | F25C 5/187 |
| JP | 2000130902 | A | 5/2000 | |

*Primary Examiner* — Frantz Jules
*Assistant Examiner* — Schyler S Sanks
(74) *Attorney, Agent, or Firm* — Dority & Manning, P.A.

(57) ABSTRACT

Refrigerator appliances are provided. A refrigerator appliance includes a cabinet defining a fresh food chamber and a freezer chamber, and a door for accessing one of the fresh food chamber or the freezer chamber. The refrigerator appliance further includes an ice making assembly disposed within one of the fresh food chamber, the freezer chamber or the door. The ice making assembly includes an ice maker, a container defining a storage volume for receipt of ice produced by the ice maker, and a chute extending between the ice maker and the container for directing the ice produced by the ice maker towards the storage volume. The chute includes a body defining a passage therethrough. The ice making assembly further includes a sensor positioned to transmit sensing signals through the chute, the sensor in communication with the ice maker.

16 Claims, 5 Drawing Sheets

(56) References Cited

U.S. PATENT DOCUMENTS

| | | | | |
|---|---|---|---|---|
| 6,862,891 | B2 * | 3/2005 | Devos | F25D 21/04 62/275 |
| 7,062,925 | B2 | 6/2006 | Tsuchikawa et al. | |
| 7,654,097 | B2 * | 2/2010 | Hawkes | F25C 5/187 222/516 |
| 8,424,323 | B2 | 4/2013 | Austin et al. | |
| 2006/0277937 | A1 * | 12/2006 | Schlosser | F25C 1/147 62/344 |
| 2008/0156005 | A1 | 7/2008 | Culley et al. | |
| 2008/0156011 | A1 * | 7/2008 | Culley | F25C 5/005 62/228.1 |
| 2010/0236271 | A1 | 9/2010 | Hawkes et al. | |
| 2010/0250005 | A1 | 9/2010 | Hawkes et al. | |
| 2011/0094254 | A1 * | 4/2011 | Kim | F25C 1/04 62/344 |
| 2012/0000899 | A1 | 1/2012 | Eom et al. | |
| 2012/0118001 | A1 * | 5/2012 | Mitchell | F25C 5/182 62/344 |
| 2012/0222433 | A1 * | 9/2012 | Park | F25C 5/187 62/66 |
| 2012/0279240 | A1 | 11/2012 | Jeong et al. | |
| 2013/0276472 | A1 * | 10/2013 | Mitchell | F25C 1/147 62/344 |

* cited by examiner

REFRIGERATOR APPLIANCES

FIELD OF THE INVENTION

The present subject matter relates generally to refrigerator appliances, and more particularly to ice making assemblies therefor and apparatus for sensing ice levels in ice making assemblies.

BACKGROUND OF THE INVENTION

Refrigerator appliances generally include a cabinet that defines a chilled chamber for receipt of food items for storage. For example, the cabinet can define a fresh food chamber and a freezer chamber. The fresh food chamber can be maintained at a temperature greater than the freezing point of water. Conversely, the freezer chamber can be maintained at a temperature equal to or less than the freezing point of water.

Certain refrigerator appliances also include an ice maker for producing ice. The ice maker can be positioned within the appliances' freezer chamber and direct ice into an ice bucket where it can be stored within the freezer chamber. Such refrigerator appliances can also include a dispensing system for assisting a user with accessing ice produced by the refrigerator appliances' ice maker. Storing ice within a refrigerator appliance's freezer chamber can have certain drawbacks. In particular, certain refrigerator appliances maintain their freezer chambers at temperatures well below the freezing point of water. Ice stored in such conditions can become cloudy and/or hard relative to ice stored at warmer temperatures. Consumers can find such cloudy and/or hard ice undesirable.

As such, a current trend that is increasing in popularity is the desire for "nugget", or chewable, ice. Such ice is typically stored at a relatively higher than normal temperature such as above 32 degrees Fahrenheit in some cases. For example, such ice may be formed and stored generally within the fresh food chamber, such as in an ice box defined in the door for accessing the fresh food chamber.

One issue with known ice makers, and in particular ice makers that make nugget ice, is clogging. In some cases, clogging is simply caused by excess ice being generated which over fills the container holding the generated ice. In other cases, and particularly when nugget ice is being generated, clogging is caused by ice freezing to components of the ice maker assembly, such as to the chute guiding the ice from the ice maker to the container. Clogging can cause ice to back up in the ice maker assembly, which can in turn cause damage to or destruction of components of the ice maker assembly.

Some known refrigerator appliances and ice maker assemblies utilize sensors mounted in the ice containers to address clogging issues. These sensors can detect ice levels within the containers. However, these sensors cannot detect ice that is frozen in the chute.

Accordingly, improved refrigerator appliances and ice maker assemblies are desired in the art. In particular, refrigerator appliances and ice maker assemblies with improved apparatus for detecting ice levels and ice clogging issue would be advantageous.

BRIEF DESCRIPTION OF THE INVENTION

Aspects and advantages of the invention will be set forth in part in the following description, or may be apparent from the description, or may be learned through practice of the invention.

In accordance with one embodiment, a refrigerator appliance is provided. The refrigerator appliance includes a cabinet defining a fresh food chamber and a freezer chamber, and a door for accessing one of the fresh food chamber or the freezer chamber. The refrigerator appliance further includes an ice making assembly disposed within one of the fresh food chamber, the freezer chamber or the door. The ice making assembly includes an ice maker, a container defining a storage volume for receipt of ice produced by the ice maker, and a chute extending between the ice maker and the container for directing the ice produced by the ice maker towards the storage volume. The chute includes a body defining a passage therethrough. The ice making assembly further includes a sensor positioned to transmit sensing signals through the chute, the sensor in communication with the ice maker.

In accordance with another embodiment, a refrigerator appliance is provided. The refrigerator appliance includes a cabinet defining a fresh food chamber and a freezer chamber, and a door rotatably hinged to the cabinet for accessing the fresh food chamber. The door includes an inner surface and an outer surface and is rotatable between an open position and a closed position. The door defines an ice box. The refrigerator appliance further includes an ice making assembly disposed within the ice box. The ice making assembly includes an ice maker, a container defining a storage volume for receipt of ice produced by the ice maker, and a chute extending between the ice maker and the container for directing the ice produced by the ice maker towards the storage volume. The chute includes a body defining a passage therethrough. The ice making assembly further includes a sensor positioned to transmit sensing signals through the chute, the sensor in communication with the ice maker.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
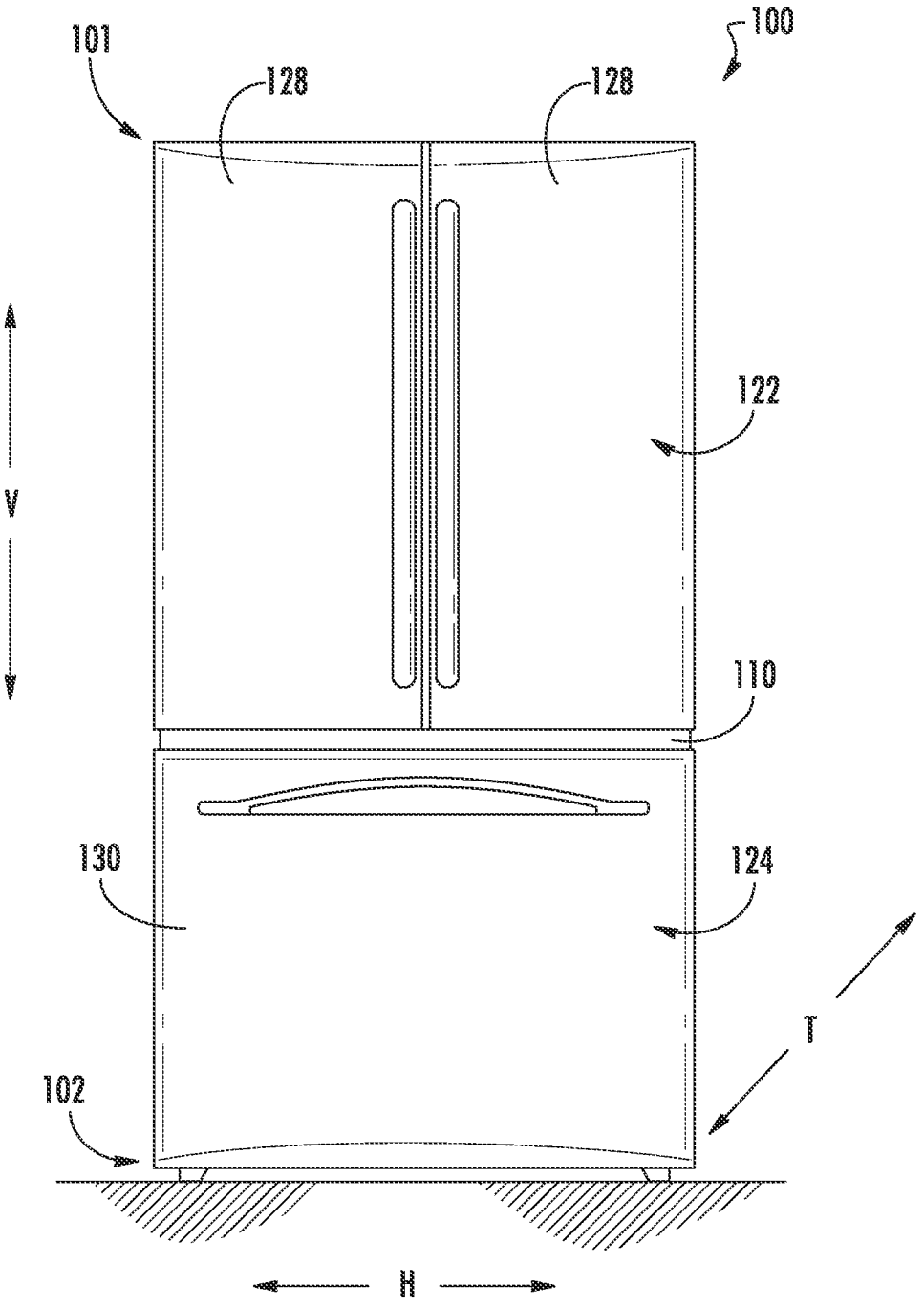
FIG. 1 provides a front, elevation view of a refrigerator appliance with doors in closed positions in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
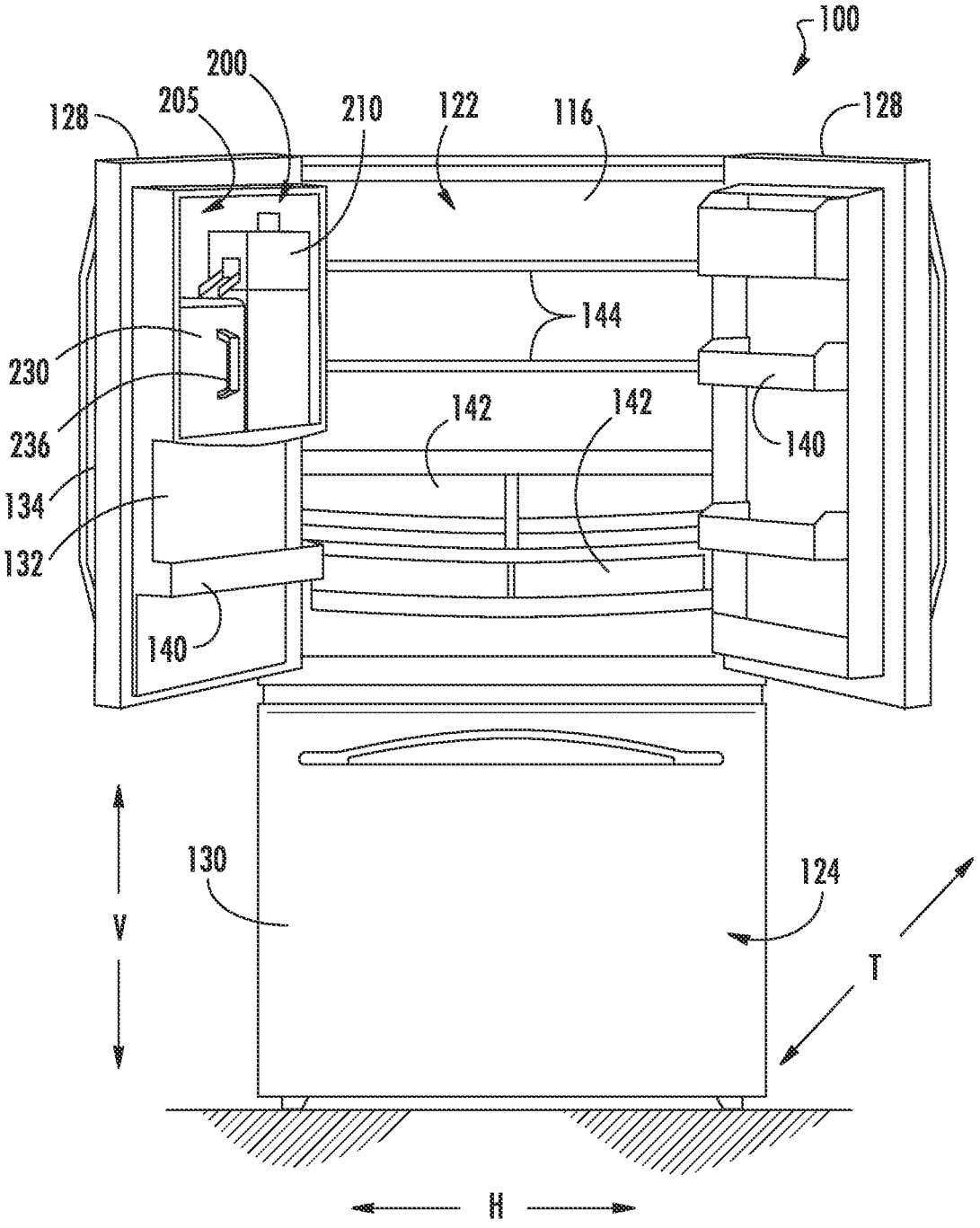
FIG. 2 provides a front, elevation view of the refrigerator appliance of FIG. 1 with doors of the refrigerator appliance shown in open positions to reveal a fresh food chamber of the refrigerator appliance and an ice making assembly in accordance with one embodiment of the present disclosure.

FIG. 1 provides a front, elevation view of a refrigerator appliance 100 according to an exemplary embodiment of the present subject matter with refrigerator doors 128 of the refrigerator appliance 100 shown in a closed position. FIG. 2 provides a front, elevation view of refrigerator appliance 100 with refrigerator doors 128 shown in an open position to reveal a fresh food chamber 122 of refrigerator appliance 100. As discussed in greater detail below, refrigerator appliance 100 includes an ice making assembly 200. In exemplary embodiments as shown, the ice making assembly 200 can be positioned, when the doors 128 are in closed positions, generally within or adjacent to a fresh food chamber 122 of refrigerator appliance 100. Alternatively, however, the ice making assembly 200 can be positioned, when the doors 128 are in closed positions, generally within or adjacent to a freezer chamber 124 of refrigerator appliance 100.

Refrigerator appliance 100 includes a cabinet or housing 110 that extends between a top portion 101 and a bottom portion 102 along a vertical direction V. Cabinet 110 defines chilled chambers for receipt of food items for storage. In particular, as shown, cabinet 110 defines fresh food chamber 122 positioned at or adjacent top portion 101 of cabinet 110 and a freezer chamber 124 arranged at or adjacent bottom portion 102 of cabinet 110. Fresh food chamber 122 is thus in these embodiments disposed above freezer chamber 124 along the vertical direction V. As such, refrigerator appliance 100 is generally referred to as a bottom mount refrigerator appliance. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

In exemplary embodiments as illustrated, cabinet 110 includes a first sidewall and a second sidewall (not shown), which are generally spaced apart along a horizontal direction H. Further, cabinet 110 may include a rear wall 116, which may be generally spaced apart from refrigerator door(s) 128 and freezer door(s) 130 of the refrigerator appliance 100 generally along a transverse direction T. The vertical, horizontal and transverse directions V, H, T may each be perpendicular to each other. Sidewalls and rear wall 116 of cabinet 110 may define the fresh food chamber 122 and freezer chamber 124.

One or more refrigerator doors 128 are rotatably mounted or hinged to an edge of cabinet 110 for selectively accessing fresh food chamber 122. Each door 128 may include an inner surface 132 and an outer surface 134, between which the door 128 is generally defined. In addition, one or more freezer doors 130 are arranged below refrigerator doors 128 for selectively accessing freezer chamber 124. Freezer door 130 is coupled to a freezer drawer (not shown) slidably mounted within freezer chamber 124. As discussed above, refrigerator doors 128 and freezer door 130 are shown in the closed position in FIG. 1, and refrigerator doors 128 are shown in the open position in FIG. 2.

Turning now to FIG. 2, various storage components are mounted within fresh food chamber 122 to facilitate storage of food items therein as will be understood by those skilled in the art. In particular, the storage components include drawers 142 and racks 144 that are mounted within fresh food chamber 122. Bins 140 may additionally be provided, such as mounted on doors 128, and may be disposed within fresh food chamber 122 when the doors 128 are in the closed position. Bins 140, drawers 142, and racks 144 are configured for receipt of food items (e.g., beverages and/or solid food items) and may assist with organizing such food items. As an example, drawers 142 can receive fresh food items (e.g., vegetables, fruits, and/or cheeses) and increase the useful life of such fresh food items.

As may be seen in FIG. 2, an ice making assembly 200 according to an exemplary embodiment of the present subject matter is included in refrigerator appliance 100. Ice making assembly 200 may be disposed within the fresh food chamber 122, the freezer chamber 124, or a door (e.g., 128 or 130). In exemplary embodiments, as discussed herein, ice making assembly 200 may be disposed within a door 128. Thus, ice-making assembly 200 can be positioned within fresh-food chamber 122, e.g., when refrigerator doors 128 are closed. Ice-making assembly 200 is configured for producing ice and is discussed in greater detail below.

Figure 3:
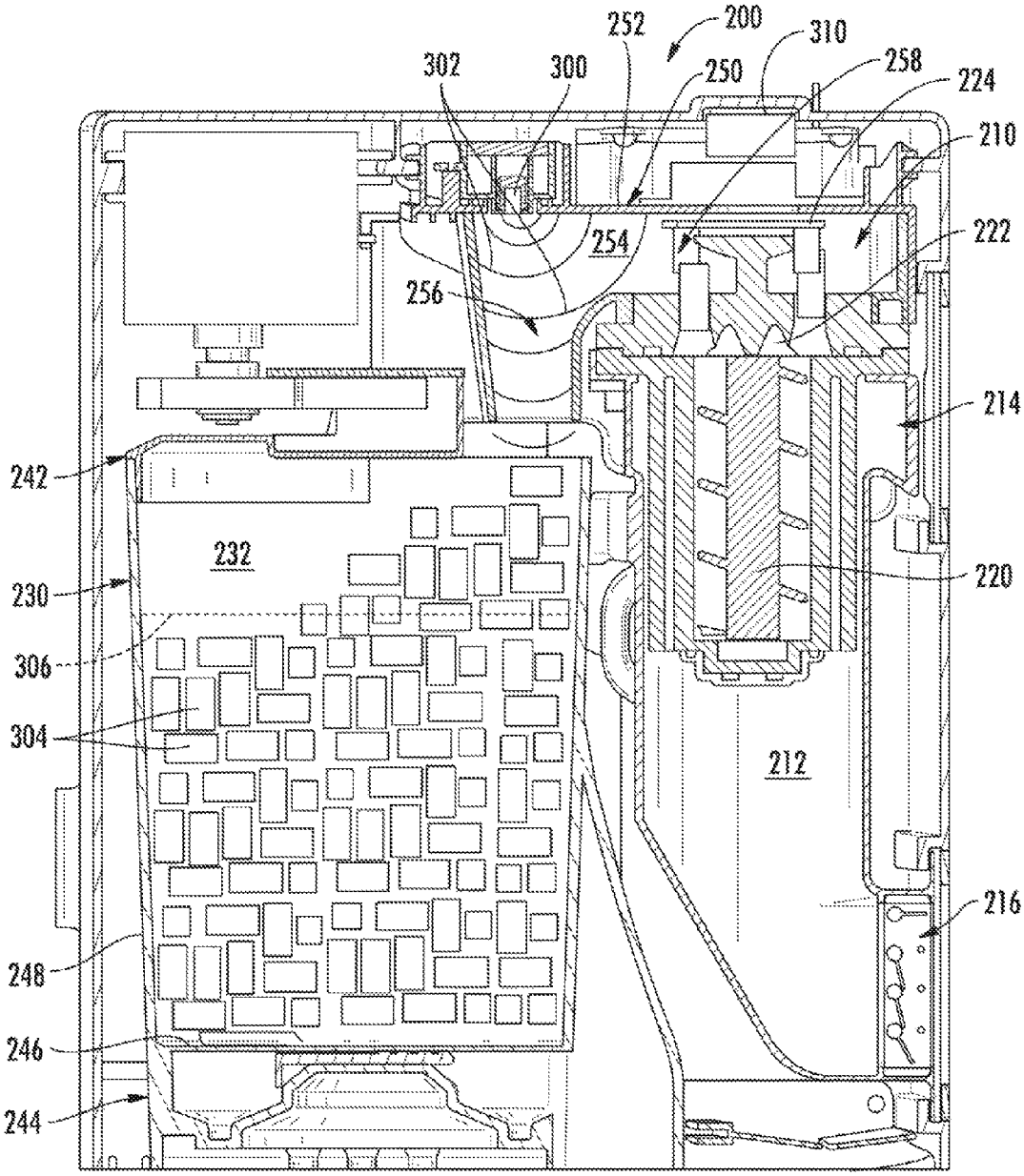
FIG. 3 provides a front, cross-sectional view of an ice making assembly, with ice illustrated in a storage volume of a container of the ice making assembly, in accordance with one embodiment of the present disclosure.
Figure 4:
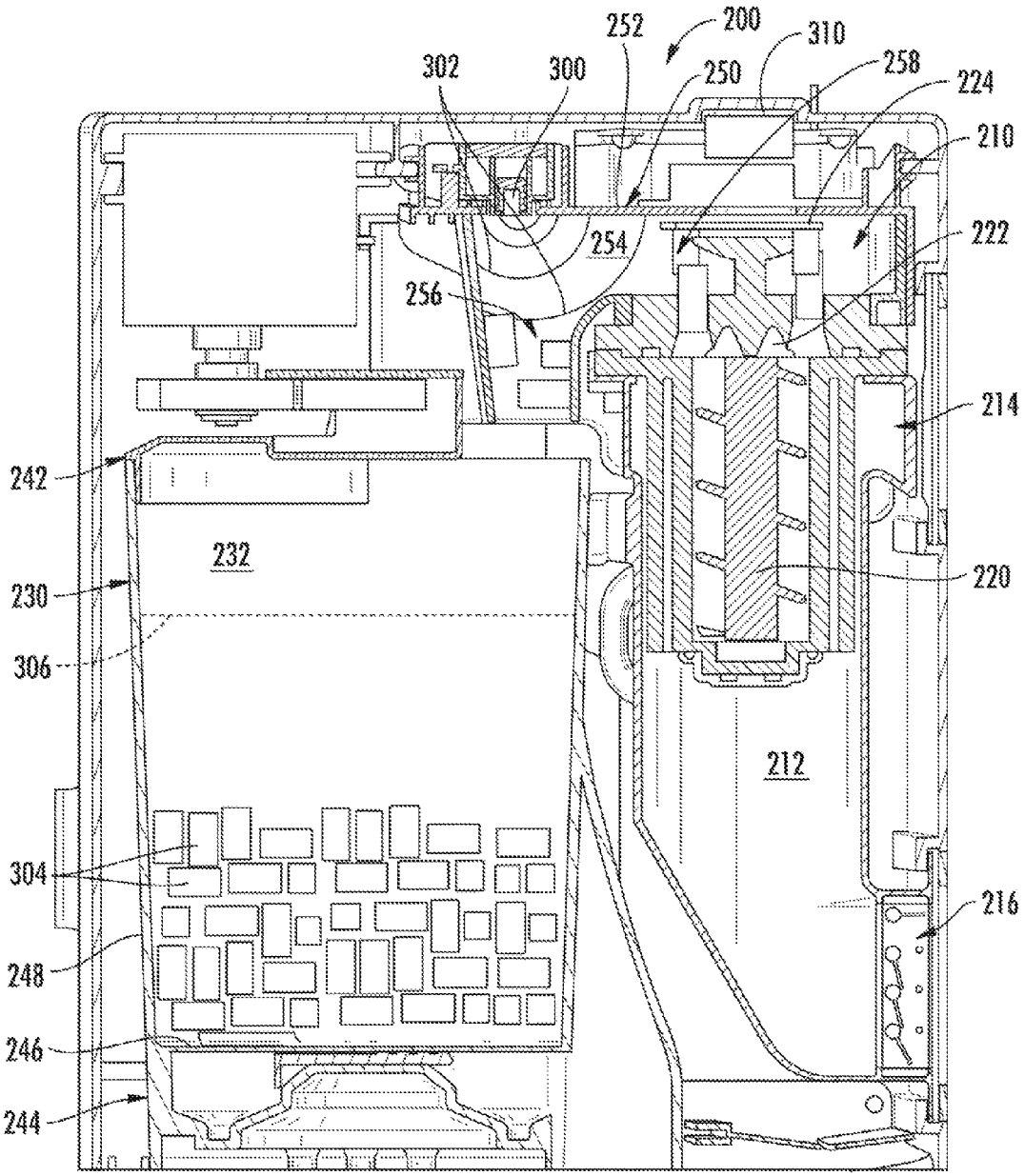
FIG. 4 provides a front, cross-sectional view of an ice making assembly, with ice illustrated in a passage of a chute of the ice making assembly, in accordance with one embodiment of the present disclosure.
Figure 5:
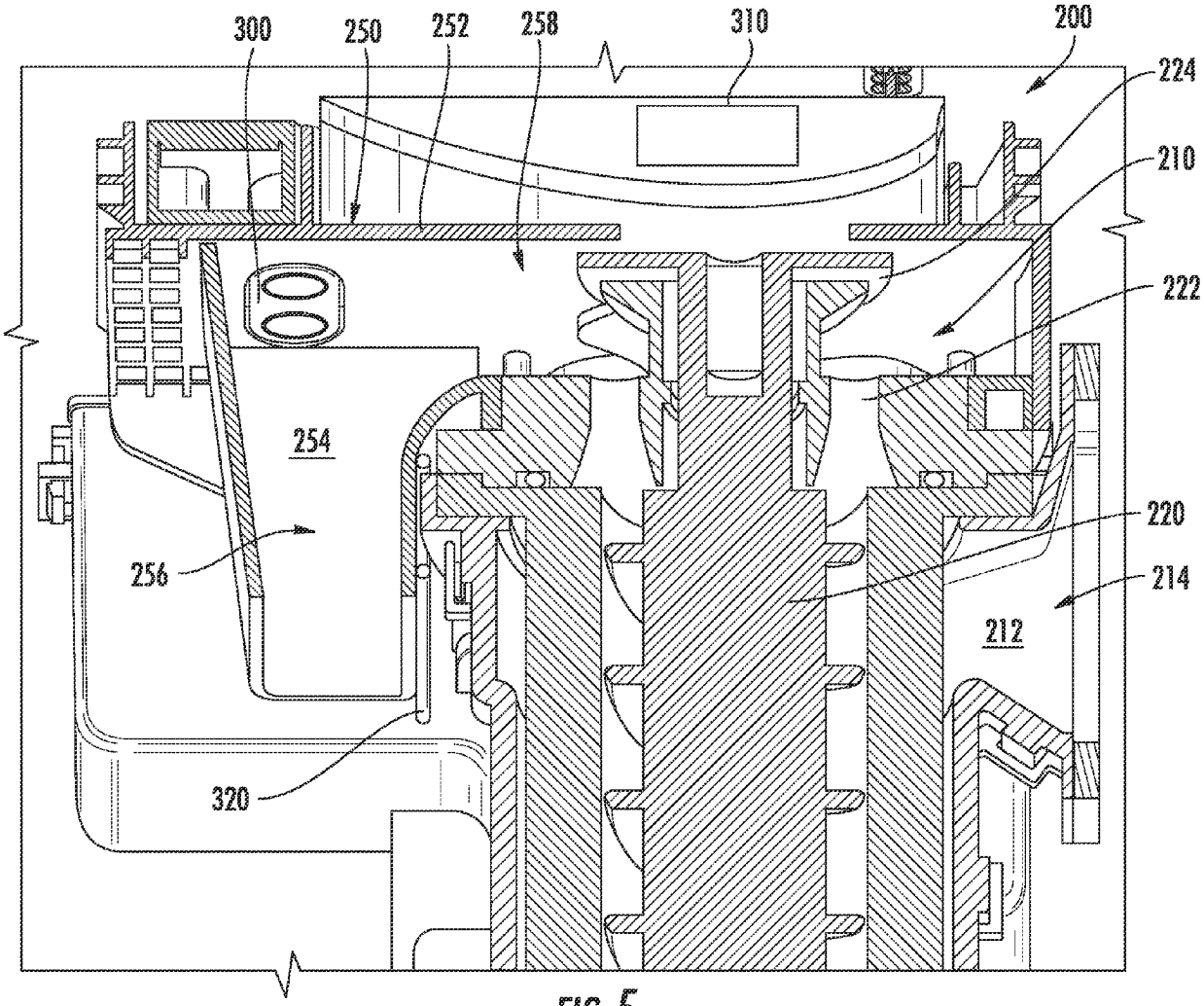
FIG. 5 provides a perspective cross-sectional view of an ice maker and chute of an ice making assembly in accordance with one embodiment of the present disclosure.

FIGS. 3 through 5 provide cross-sectional views of ice making assemblies 200 in accordance with embodiments of the present disclosure. In embodiments wherein ice-making assembly 200 is disposed within a door 128, ice-making assembly 200 generally includes an ice box 205, which is generally an area defined in one of the doors 128. Various components of the ice-making assembly 200, such as an ice maker 210 and a container 230, may be disposed within the ice box 205. Ice maker 210 is configured for producing ice. As an example, ice maker 210 can be a nugget or auger style ice maker. Referring again briefly to FIG. 2, ice box 205 and ice maker 210 may be positioned within fresh food chamber 122 when refrigerator doors 128 are closed. In these embodiments, ambient air within fresh food chamber 122 is not maintained at a sufficiently low temperature to permit formation of ice by ice maker 210. For example, ice within storage volume 232 of container 230 may be maintained or stored at a temperature greater than the melting point of water or greater than about thirty-two degrees Fahrenheit. Thus, referring again to FIGS. 3 through 5, ice maker 210 includes a chilled air duct 212, which include an inlet 214 and an outlet 216. Chilled air duct 212 can direct chilled air from freezer chamber 124 to other components of ice maker 210 through inlet 214. Because chilled air within freezer chamber 124 can have a sufficiently low temperature to permit formation of ice, chilled air therefrom can assist or permit ice maker 210 to produce ice despite the position of ice maker 210 within fresh food chamber 122. Chilled air outlet 216 can direct air away back to freezer chamber 124.

As mentioned, ice maker 210 in some embodiments is an auger-style ice maker. In these embodiments, ice maker 210 may include an auger 220 and an extruder 222. The auger 220 may, for example, be disposed at least partially within the chilled air duct 212. Auger 220 may receive water from a water supply (not shown). The water may at least partially freeze within auger 220, and may be directed by auger 220 to and through extruder 222. The extruder 222 may extrude the at least partially frozen water to form nuggets of ice.

Ice formed by ice maker 210 can be stored in container 230, such as in a storage volume 230 defined by the container 230. Storage volume 232 is defined by container 230 and is configured for receipt of ice produced by ice maker 210. Container 230 is removably positioned or mounted in ice making assembly 200. For example, as shown, container 230 can be removably positioned on or mounted to refrigerator door 128 within ice box 205. As an example, a user can grasp a handle 236 (FIG. 2) of container 230 in order to remove container 230 from ice making assembly 200 and, e.g., place container 230 on a countertop or table such that the user can more easily access ice within storage volume 232 of container 230.

Container 230 extends between a top portion 242 and a bottom portion 244 along the vertical direction V. Ice from ice maker 210 can enter storage volume 232 of container 230 at top portion 242 of container 230 and rest within storage volume 232 of container 230 at bottom portion 244 of container 230. In particular, container 230 includes a bottom wall 246 positioned at bottom portion 244 of container 230. Ice within storage volume 232 of container 230 can rest on bottom wall 246. Container 230 also includes a sidewall 248 connected to bottom wall 246 and extending along the vertical direction V, e.g., between top and bottom portions 242 and 244 of container 230.

Ice maker assembly 200 also includes an ice chute 250. Ice chute 250 directs ice produced by ice maker 210, e.g., into storage volume 232 of container 230. As shown, ice chute 250 is generally positioned above container 230 along the vertical direction V. Thus, ice can slide off of ice chute 250 and drop into storage volume 232 of container 230. Chute 250 includes a body 252 which defines a passage 254 therethrough. Ice is directed from the ice maker 210 through the passage 254 to the container 230. In some embodiments, for example, a sweep 224, which may for example be connected to and rotate with the auger, may contact the ice emerging through the extruder 222 from the auger 220 and direct the ice through the passage 254 to the container 230.

Chute 250 can generally direct the ice in any suitable direction(s) to facilitate the movement of the ice from the ice maker 210 to the container 230. In exemplary embodiments as illustrated, for example, passage 254 can include a generally longitudinal portion 256 and a generally radial portion 258. The longitudinal portion 256 may, for example, extend generally along the vertical direction V between the container 230 and the radial portion 258. The radial portion 258 be extend generally along the horizontal direction H, the transverse direction T, or any suitable angle between the horizontal and transverse directions H, T, between the ice maker 210 and the longitudinal portion 256. Notably, radial portion 258 may additionally extend at an angle to the plane defined by the horizontal direction H and transverse direction T in order that gravity can assist the movement of ice, or may extend within such plane. Ice may this be directed from the ice maker 210 to the generally radial portion 258, from the generally radial portion 258 to the generally longitudinal portion 256, and from the generally longitudinal portion 256 to the storage volume 232.

As mentioned, improved apparatus for detecting ice levels and ice clogging issue in ice making assemblies 200 would be advantageous. Accordingly, one or more sensors 300 may be included in an ice making assembly 200 in accordance with the present disclosure. Sensors 300 may advantageously be positioned to transmit sensing signals 302 through the chute 250, such as through the passage 254 thereof, and further potentially to and through the storage volume 232. The transmission of the sensing signals 302 through the chute 250, and receipt of the sensing signals as discussed herein, may advantageously provide improved ice level and ice clogging issue detection.

As illustrated, in exemplary embodiments, a sensor 300 may be mounted to the body 252, such as via suitable mechanical fasteners, adhesive, etc. Sensor 300 may further extend through the body 252, as illustrated, or be mounted within the passage 254, etc., such that sensing signals 302 can be transmitted through the passage 254. Alternatively, any suitable positioning of sensor 300 such that sensing signals 302 can be transmitted through the passage 254 are within the scope and spirit of the present disclosure.

In exemplary embodiments as illustrated, a sensor 300 is positioned to transmit (and optionally receive, as discussed herein) sensing signals 302 through the generally longitudinal portion 256 of the passage 254, such that the sensing signals 302 can further be transmitted to and received from the storage volume 232. Accordingly, sensing signals 302 may move generally along the vertical direction V. Of course, it should be understood that the direction of the sensing signals 302 is not limited to movement along any particular direction. For example, signals 302 may radiate outward from a transmission location, and may be deflected in various suitable directions, depending on the environment through which the signals 302 travel.

In exemplary embodiments, sensor 300 can further receive the sensing signals 302 that are transmitted therefrom. Accordingly, sensing signals 302 may be transmitted from the sensor 300 through the passage 254, may further move from the passage 254 into the chute 232, and may after encountering an obstruction to the path of movement of the signals 302 move back towards and be received by the sensor 300. In some embodiments, for example, a sensor 300 may be a radiation sensor, and the sensing signals 302 may be radiation signals. The radiation signals may be in any suitable class(es) along the electromagnetic spectrum. For example, the sensor 300 may be an infrared radiation sensor and the sensing signals 302 may be infrared radiation signals, or the sensor 300 may be a visible light sensor and the sensing signals 302 may be visible radiation signals, or the sensor 300 may be an ultraviolet radiation sensor and the sensing signals 302 may be ultraviolet radiation signals. In other embodiments, for example, a sensor 300 may be an acoustic sensor, and the sensing signals 302 may be acoustic signals. In still other embodiments, any suitable sensors 300 and associated sensing signals 302 which are capable of being transmitted and optionally received by the associated sensors 300 are within the scope and spirit of the present disclosure.

Sensor 300 may further advantageously be in communication with the ice maker 210, such as through a controller 310. Controller 310 may for example be configured to operate the ice maker 210 based on signals 302 received from the sensor 300 or another suitable component that receives signals 302 transmitted from the sensor 300. In particular, controller 310 may be configured to de-activate the ice maker 210, in order to temporarily cease ice making, when an excess ice or clog condition is indicated by the sensing signals 302. For example, controller 310 may be configured to de-activate the ice maker 210 when the received sensing signals 302 exceed a predetermined threshold. The predetermined threshold may for example be a time threshold, a distance threshold, or an amount threshold for the signals 302. For example, controller 310 may measure the time for transmitted sensing signals 302 to be received. Such time measurements may for example be utilized when the sensor is an acoustic sensor. A sensing signal 302 may exceed a predetermined threshold if the time is less than the predetermined threshold, which would indicate that the sensing signal 302 encountered an obstruction that is closer than a predetermined obstruction limit, and thus for example has moved back to be received by the sensor 300 quicker than would occur if the obstruction was within the predetermined obstruction limit. In these embodiments, controller 310 may compare the time to a time threshold, or may convert the time to a distance and compare the distance to a distance threshold. Alternatively, controller 310 may measure the amount of transmitted sensing signals 302 that are received, relative to the amount transmitted. Such amount measurements may for example be utilized when the sensor is a radiation sensor. A sensing signal 302 may exceed a predetermined threshold if the amount is greater than the predetermined threshold, which would indicate that the sensing signal 302 encountered an obstruction that is closer than a predetermined obstruction limit, thus causing more of the transmitted signal to move back to be received by the sensor 300 than would occur if the obstruction was within the predetermined obstruction limit. The obstruction limit may, for example, be a distance from the sensor 300 to a desired location in the storage volume 232 which is indicative of a desired limit on the amount of ice that the storage volume 232 can contain.

Controller 310 may include one or more memory devices and one or more microprocessors, such as general or special purpose microprocessors operable to execute programming instructions or micro-control code associated with sensor 300 and ice maker 210 operation. The memory may represent random access memory such as DRAM, or read only memory such as ROM or FLASH. In one embodiment, the processor executes programming instructions stored in memory. The memory may be a separate component from the processor or may be included onboard within the processor.

FIG. 3 illustrated one embodiment of operation of sensor 300 and sensing signals 302, in which sensing signals 302 encounter ice (denoted as reference number 304) above a predetermined desired level 306 in the storage volume 322. When the predetermined desired level 306 is exceeded, the distance that the signals 302 travel is less than that at the predetermined desired level 306, which causes the received sensing signals 302 to exceed the associated and correlated predetermined threshold. Accordingly, controller 310 may de-activate the ice maker 210 until the ice level is below the predetermined desired level 306.

FIG. 4 illustrates another embodiment of operation of sensor 300 and sensing signals 302, in which sensing signals 302 encounter ice 304 that has become frozen to body 352 of chute 350. This frozen ice 304 can cause a clog in the passage 254, even when the ice in the storage volume 232 is not above the determined desired level 306. However, due to the location of the sensor 300, the signals 302 may encounter this ice 304, such that the distance that the signals 302 travel is less than that at the predetermined desired level 306, which causes the received sensing signals 302 to exceed the associated and correlated predetermined threshold. Accordingly, controller 310 may de-activate the ice maker 210 until the frozen ice 304 is cleared from the body 252 and passage 254.

Notably, when the ice level is reduced or the clog cleared, and the received sensing signals 302 no longer exceed the predetermined threshold, the controller 310 may re-activate the ice maker 210 such that the ice maker 210 again forms ice as desired.

Referring now to FIG. 5, in some embodiments, ice making assembly 200 may further include one or more heating elements 320. The heating elements 320 may operate to reduce or prevent ice clogging during operation of the ice making assembly 200. Any suitable heating elements 320 may be utilized, including metal, ceramic or composite heating elements. In general, a heating element 320 in accordance with the present disclosure may convert electricity from a power source (not shown) into heat through resistive heating.

A heating element 320 may, for example, be mounted to the body 252 of the chute 250, such as to the portion of the body 252 that defines the longitudinal portion 256 as illustrated and/or the portion of the body 252 that defines the radial portion 258. As illustrated, the heating element(s) 320 may in exemplary embodiments be mounted to the exterior of the body 252.

When operating, a heating element 320 may heat the portion of the body 252 to which it is mounted. This may advantageously reduce or prevent ice from freezing to these portions of the body 252. In some embodiments, a heating element 320 may operate generally constantly, while in other embodiments a heating element 320 may only operate during specified periods. For example, a heating element 320 may be in communication with the ice maker 210, such as through controller 310. In some embodiments, heating element 320 may be active when the ice maker 210 is active. In other embodiments, heating element 320 may be active when the ice maker 210 is deactivated.

Accordingly, the present disclosure advantageously provides improved ice making assemblies 210 and refrigerator appliances 100 that advantageously address multiple ice making issues, including ice level and ice clogging concerns. Use of such ice making assemblies 210 and refrigerator appliances 100 may advantageously reduce occurrences of such issues and associated damage to the ice making assemblies 210 and refrigerator appliances 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food chamber and a freezer chamber;

a door for accessing one of the fresh food chamber or the freezer chamber; and an ice making assembly disposed within the cabinet or the door, the ice making assembly comprising:

an ice maker;

a container defining a storage volume for receipt of ice produced by the ice maker;

a chute extending between the ice maker and the container for directing the ice produced by the ice maker towards the storage volume, the chute comprising a body defining a passage therethrough, the passage comprising a radial portion and a longitudinal portion, the longitudinal portion extending along a vertical direction above the storage volume, the passage being positioned such that ice is directed from the ice maker to the radial portion, from the radial portion to the longitudinal portion, and from the longitudinal portion to the storage volume; and a sensor mounted to an upper wall of the body, the upper wall extending horizontally from the ice maker to a sidewall, the sensor mounted above the longitudinal portion and directed toward the container to transmit sensing signals in the vertical direction through the longitudinal portion of the chute toward the storage volume, the sensor being further mounted downstream from the ice maker such that the radial portion is positioned between the sensor and the ice maker, the sensor being in communication with the ice maker, wherein the body comprises the sidewall, the sidewall defining at least a portion of the chute at the longitudinal portion, and wherein the sidewall extends downward along the vertical direction at an acute angle from the upper wall.

2. The refrigerator appliance of claim 1, further comprising a controller, the controller configured to operate the ice maker based on sensing signals received from the sensor.

3. The refrigerator appliance of claim 1, wherein the sensor is a radiation sensor and the sensing signals are radiation signals.

4. The refrigerator appliance of claim 1, wherein the sensor is an acoustic sensor and the sensing signals are acoustic signals.

5. The refrigerator appliance of claim 1, wherein the sensor is directed toward the storage volume to transmit sensing signals through the longitudinal portion to the storage volume.

6. The refrigerator appliance of claim 1, further comprising a heating element mounted to the body of the chute.

7. The refrigerator appliance of claim 1, wherein the door is rotatably hinged to the cabinet for accessing the fresh food chamber and comprises an inner surface and an outer surface and defines an ice box, and wherein the ice making assembly is disposed within the ice box.

8. The refrigerator appliance of claim 1, wherein ice within the storage volume of the container is maintained at a temperature greater than thirty-two degrees Fahrenheit.

9. The refrigerator appliance of claim 1, wherein the ice maker comprises an auger and an extruder.

10. The refrigerator appliance of claim 2, wherein the sensor further receives sensing signals that are transmitted through the chute, and wherein the controller is configured to de-activate the ice maker when the received sensing signals exceed a predetermined threshold.

11. The refrigerator appliance of claim 3, wherein the radiation sensor is an infrared radiation sensor and the radiation signals are infrared radiation signals.

12. The refrigerator appliance of claim 6, wherein the heating element is in communication with the ice maker, and wherein the heating element is active when the ice maker is actively engaged in the production of ice.

13. The refrigerator appliance of claim 6, wherein the heating element is mounted to a portion of the body defining the longitudinal portion.

14. A refrigerator appliance, comprising:

a cabinet defining a fresh food chamber and a freezer chamber;

a door rotatably hinged to the cabinet for accessing the fresh food chamber, the door comprising an inner surface and an outer surface and rotatable between an open position and a closed position, the door defining an ice box;

an ice making assembly disposed within the ice box, the ice making assembly comprising:

an ice maker;

a container defining a storage volume for receipt of ice produced by the ice maker;

a chute extending between the ice maker and the container for directing the ice produced by the ice maker towards the storage volume, the chute comprising a body defining a passage therethrough, the passage comprising a radial portion and a longitudinal portion, the longitudinal portion extending along a vertical direction above the storage volume, the passage being positioned such that ice is directed from the ice maker to the radial portion, from the radial portion to the longitudinal portion, and from the longitudinal portion to the storage volume; and a sensor mounted to an upper wall of the body, the upper wall extending horizontally from the ice maker to a sidewall, the sensor mounted above the longitudinal portion and directed toward the container to transmit sensing signals in the vertical direction through the longitudinal portion of the chute toward the storage volume, the sensor being further mounted downstream from the ice maker such that the radial portion is positioned between the sensor and the ice maker, the sensor being in communication with the ice maker, wherein the body comprises the sidewall, the sidewall defining at least a portion of the chute at the longitudinal portion, and wherein the sidewall extends downward along the vertical direction at an acute angle from the upper wall.

15. The refrigerator appliance of claim 14, further comprising a heating element mounted to the body of the chute.

16. The refrigerator appliance of claim 14, wherein ice within the storage volume of the container is maintained at a temperature greater than thirty-two degrees Fahrenheit.

* * * * *